US008761634B2

(12) United States Patent
Mori et al.

(10) Patent No.: US 8,761,634 B2
(45) Date of Patent: Jun. 24, 2014

(54) CARTRIDGE ASSEMBLY OF AN IMAGE FORMING DEVICE INCLUDING A DRUM CARTRIDGE AND A DEVELOPING CARTRIDGE DETACHABLY MOUNTABLE ON THE DRUM CARTRIDGE

(75) Inventors: Hiroki Mori, Nagoya (JP); Masatoshi Shiraki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 12/726,205

(22) Filed: Mar. 17, 2010

(65) Prior Publication Data

US 2010/0303499 A1 Dec. 2, 2010

(30) Foreign Application Priority Data

May 29, 2009 (JP) ..... 2009-130902

(51) Int. Cl.
*G03G 21/18* (2006.01)

(52) U.S. Cl.
CPC ..... *G03G 21/1846* (2013.01); *G03G 21/1817* (2013.01)
USPC ..... 399/113

(58) Field of Classification Search
CPC ..... G03G 21/1846; G03G 2221/1846; G03G 21/1817; G03G 2221/1853; G03G 2221/1861; G03G 21/1839; G03G 21/1842
USPC ..... 399/111, 113
See application file for complete search history.

(56) References Cited

U.S. PATENT DOCUMENTS 6,152,555 A * 11/2000 Nozawa et al.
6,674,982 B2 1/2004 Saitoh et al.

(Continued)

FOREIGN PATENT DOCUMENTS

CN 101057187 A 10/2007
JP 4-93849 U 8/1992

(Continued)

OTHER PUBLICATIONS

Japanese Office Action mailed Mar. 8, 2011 in Japanese Application No. 2009-130902 and English translation thereof.

(Continued)

*Primary Examiner* — Walter L Lindsay, Jr.
*Assistant Examiner* — Milton Gonzalez
(74) *Attorney, Agent, or Firm* — Banner & Witcoff, Ltd.

(57) ABSTRACT

A cartridge assembly detachably mounted on a main casing of an image forming device includes a first cartridge having a first handle, a second cartridge having a second handle, and a lock member having a lock section and an operation section. The first handle and the second handle provide a relative position capable of realizing single-handed simultaneous access to the first handle and the second handle in case of an assembled state between the second cartridge and the first cartridge for integral attachment to or detachment from the main casing. The second handle and the operation section are configured to provide a relative position capable of realizing single-handed simultaneous access to the second handle and the operation section to move the lock section from the lock position to the unlock position for detachment of the second cartridge from the first cartridge.

8 Claims, 10 Drawing Sheets

(56) References Cited

U.S. PATENT DOCUMENTS

| | | | | |
|---|---|---|---|---|
| 6,751,428 | B2 * | 6/2004 | Okabe | 399/111 |
| 6,792,230 | B2 * | 9/2004 | Saito et al. | 399/111 |
| 7,260,342 | B2 | 8/2007 | Nishimura | |
| 7,298,990 | B2 | 11/2007 | Nishimura | |
| 7,512,363 | B2 | 3/2009 | Kamimura | |
| 2002/0037178 | A1 | 3/2002 | Saitoh et al. | |
| 2003/0086723 | A1 | 5/2003 | Yamaguchi et al. | |
| 2004/0037587 | A1 | 2/2004 | Yamaguchi et al. | |
| 2005/0008395 | A1 | 1/2005 | Yamaguchi et al. | |
| 2005/0191090 | A1 * | 9/2005 | Nishimura | 399/113 |
| 2005/0260019 | A1 | 11/2005 | Arai | |
| 2006/0133850 | A1 | 6/2006 | Nishimura | |
| 2006/0245786 | A1 | 11/2006 | Suzuki | |
| 2007/0071483 | A1 | 3/2007 | Kamimura | |
| 2007/0223965 | A1 * | 9/2007 | Takagi | 399/113 |
| 2008/0212997 | A1 * | 9/2008 | Sato | 399/119 |
| 2008/0226341 | A1 * | 9/2008 | Mase et al. | 399/119 |
| 2008/0298837 | A1 * | 12/2008 | Mase | 399/119 |
| 2008/0310881 | A1 * | 12/2008 | Sato | 399/111 |
| 2009/0180802 | A1 | 7/2009 | Sato et al. | |

FOREIGN PATENT DOCUMENTS

| | | | |
|---|---|---|---|
| JP | 5-29051 | U | 4/1993 |
| JP | 2002-108170 | A | 4/2002 |
| JP | 2003-202793 | | 7/2003 |
| JP | 2005-242067 | A | 9/2005 |
| JP | 2006-011360 | | 1/2006 |
| JP | 2006-106020 | A | 4/2006 |
| JP | 2006-308802 | | 11/2006 |
| JP | 2007-086600 | A | 4/2007 |
| JP | 2008-32755 | A | 2/2008 |

OTHER PUBLICATIONS

The First Office Action for patent application No. 201010157250.8 mailed Dec. 15, 2011.

* cited by examiner

CARTRIDGE ASSEMBLY OF AN IMAGE FORMING DEVICE INCLUDING A DRUM CARTRIDGE AND A DEVELOPING CARTRIDGE DETACHABLY MOUNTABLE ON THE DRUM CARTRIDGE

CROSS REFERENCE TO RELATED APPLICATION

This application claims priority from Japanese Patent Application No. 2009-130902 filed May 29, 2009. The entire content of the priority application is incorporated herein by reference.

TECHNICAL FIELD

The present invention relates to a cartridge assembly including a plurality of cartridges assembled to each other, such as a process unit (process cartridge) and a developing unit constituting a part of an image forming device.

BACKGROUND

In a conventional image forming device, such as a laser printer, a process cartridge (process unit) is detachably mounted to a main casing. The process cartridge includes, for example, a drum cartridge and a developing cartridge. The drum cartridge includes a photosensitive drum. The developing cartridge is detachably mounted to the drum cartridge and includes a developing roller that supplies toner to a surface of the photosensitive drum.

In the image forming device provided with the process cartridge, the drum cartridge and the developing cartridge can be integrally detached from and attached to the main casing as an integral process cartridge. Further, only the developing cartridge can be detached from and attached to the main casing with separating the developing cartridge from the drum cartridge, while maintaining the drum cartridge in the main casing.

Further, such a conventional process cartridge is provided with a lock lever. The lock lever prohibits separation of the developing cartridge from the drum cartridge in order to prevent undesired separation. The lock lever is disposed at one widthwise end portion of the drum cartridge. When the developing cartridge is assembled to the drum cartridge, a lower end portion of the lock lever is engaged with a predetermined portion of the developing cartridge from above. When an upper end portion of the lock lever is pressed down, the lower end portion is disengaged from the predetermined portion. Accordingly, the developing cartridge can be separated from the drum cartridge.

SUMMARY

Such a lock lever can prevent the developing cartridge from accidentally falling off the drum cartridge while the process cartridge is removed from the main casing. However, in order to separate the developing cartridge from the drum cartridge, a user needs to press down the upper end portion of the lock lever by one hand while holding the developing cartridge by another hand. In other words, the developing cartridge cannot be separated from the drum cartridge with only one hand. Hence, separation of the developing cartridge from the drum cartridge needs troublesome labor and is not user-friendly.

Incidentally, the developing unit is another example of the cartridge assembly. The developing unit includes a roller cartridge and a toner cartridge assembled thereto. The roller cartridge accommodates therein a developing roller and a toner supply roller, and the toner cartridge accommodates therein a toner to be supplied to the roller cartridge. Therefore, in case of the developing unit, easy separation of the toner cartridge from the roller cartridge is required.

In view of the foregoing, it is an object of the present invention to provide a cartridge assembly such as a process cartridge and a developing unit of an image forming device with enhanced operability at the time of separation of a second cartridge (such as the developing cartridge and the toner cartridge) from a first cartridge (such as the drum cartridge and the roller cartridge) as well as with enhanced prevention of the second cartridge from undesired separation from the first cartridge.

In order to attain the above and other objects, the present invention provides a cartridge assembly detachably mounted on a main casing of an image forming device including a first cartridge, a second cartridge, and a lock member. The first cartridge has a first handle. The second cartridge is detachably mounted on the first cartridge and has a second handle. The first handle and the second handle are configured to provide a relative position capable of realizing simultaneous access to the first handle and the second handle in case of an assembled state between the second cartridge and the first cartridge for integral attachment to or detachment from the main casing. The lock member has a lock section and an operation section. The lock section is movable between a lock position to prohibit separation of the second cartridge from the first cartridge and an unlock position to permit separation of the second cartridge from the first cartridge. The lock section is maintained in the lock position in the assembled state of the second cartridge to the first cartridge. The operation section is configured to move the lock section between the lock position and the unlock position. The first handle and the operation section are configured to provide a relative position capable of realizing simultaneous access to the first handle and the operation section to move the lock section from the lock position to the unlock position for detachment of the second cartridge from the first cartridge.

BRIEF DESCRIPTION OF THE DRAWINGS

The particular features and advantages of the present invention as well as other objects will become apparent from the following description taken in connection with the accompanying drawings, in which.

DETAILED DESCRIPTION

Figure 1:
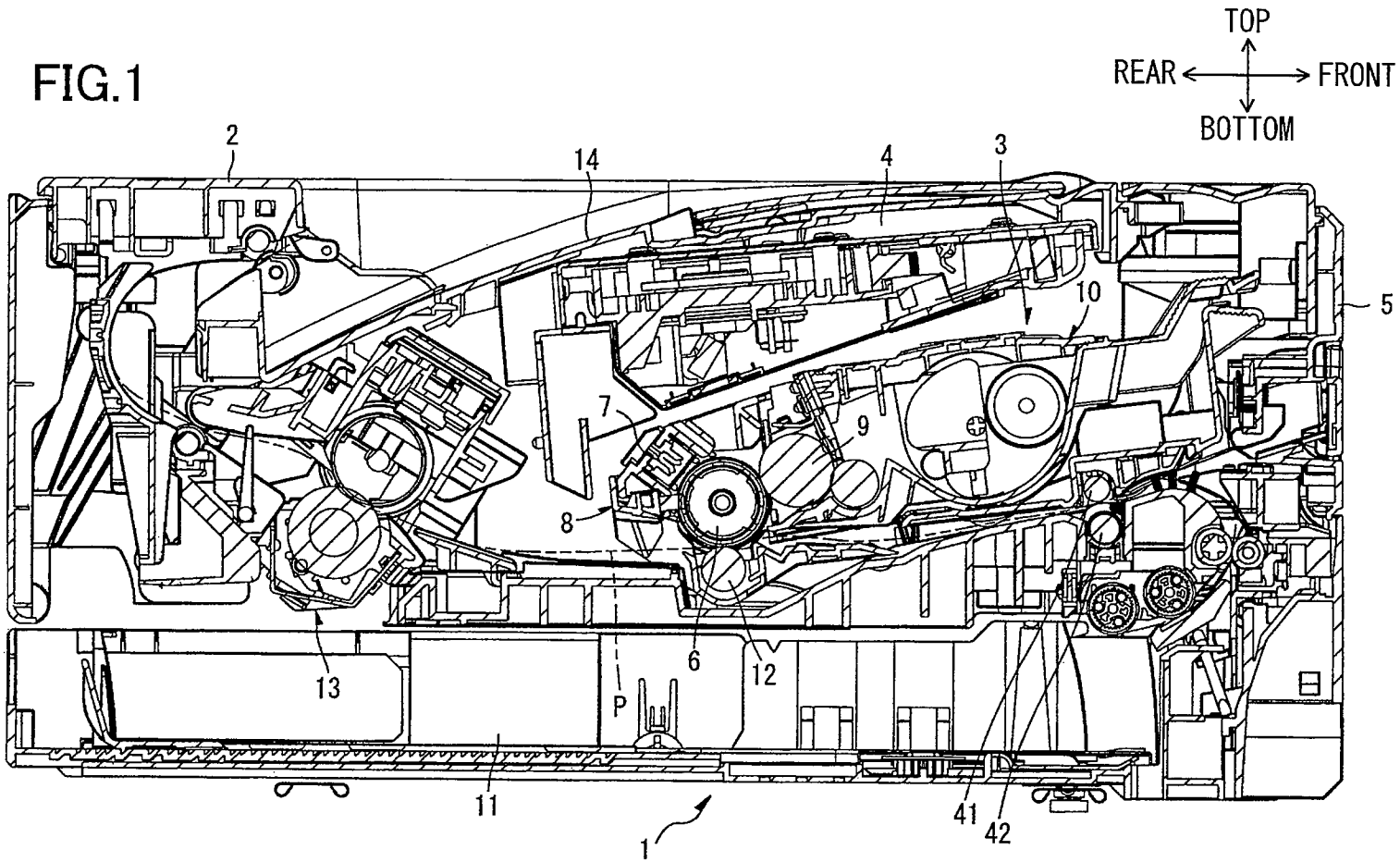
FIG. 1 is a side cross-sectional view of a printer according to one embodiment of the present invention.

Next, a printer as an image forming device according to one embodiment of the present invention will be described with reference to FIGS. 1 through 10.

1. Overall Structure of Printer

The printer 1 includes a main casing 2. Within the main casing 2, a process cartridge 3, an exposure unit 4, a sheet supply cassette 11, a fixing unit 13, and a discharge tray 14 are provided. The process cartridge 3 is disposed at a central part of the main casing 2. The exposure unit 4 is disposed above the process cartridge 3 and provided with a laser emission unit.

The main casing 2 has a front opening at which a front door 5 is provided. The front door 5 is pivotally movable between an open position and a closed position about a lower end portion thereof. When the front door 5 is pivotally moved to the open position, the process cartridge 3 is exposed to an atmosphere. The process cartridge 3 is detachable from and attachable to the main casing 2 through the front opening.

The process cartridge 3 includes a drum cartridge 8 and a developing cartridge 10. The drum cartridge 8 includes a photosensitive drum 6 and a scorotron charger 7. The developing cartridge 10 includes a developing roller 9 and a toner supply roller 19. The developing cartridge 10 is detachably assembled to the drum cartridge 8 so that a part of a circumferential surface of the developing roller 9 is brought into contact with a circumferential surface of the photosensitive drum 6.

In association with rotation of the photosensitive drum 6, the surface of the photosensitive drum 6 is uniformly charged by the scorotron charger 7. The photosensitive drum 6 is then selectively exposed by a laser beam emitted from the exposure unit 4, so that an electrostatic latent image based on image data is formed on the surface of the photosensitive drum 6. When the electrostatic latent image opposes the developing roller 9, electric potential difference between the electrostatic latent image and the developing roller 9 supplies toner to the electrostatic latent image from the developing roller 9. Therefore, a visible toner image corresponding to the electrostatic latent image can be formed on the surface of the photosensitive drum 6.

The sheet supply cassette 11 is provided in a lower section of the main casing 2. The sheet supply cassette 11 accommodates a sheet P therein. Each sheet P is conveyed from the sheet supply cassette 11, and passes between the photosensitive drum 6 and a transfer roller 12 disposed opposite to the photosensitive drum 6. Upon facing the transfer roller 12, the toner image formed on the surface of the photosensitive drum 6 is transferred onto the sheet P passing between the photosensitive drum 6 and the transfer roller 12. The transfer roller 12 is retained in the drum cartridge 8.

The fixing unit 13 is provided at a position downstream of the process cartridge 3 in a conveying direction of the sheet P. The sheet P onto which the toner image was transferred is conveyed to the fixing unit 13. In the fixing unit 13, the toner image is fixed on the sheet P by heat and pressure. The discharge tray 14 is provided in a top surface of the main casing 2. The sheet P on which an image has been fixed is discharged to the discharge tray 14 by various rollers.

Note that, throughout the specification, the terms "above", "below", "right", "left", "front", "rear" and the like will be used assuming that the printer 1 is disposed in an orientation in which it is intended to be used. More specifically, in FIG. 1, a left side and a right side are a rear side and a front side, respectively.

2. Process Cartridge

As described above, the process cartridge 3 includes the drum cartridge 8 and the developing cartridge 10.

2-1. Drum Cartridge

Figure 3:
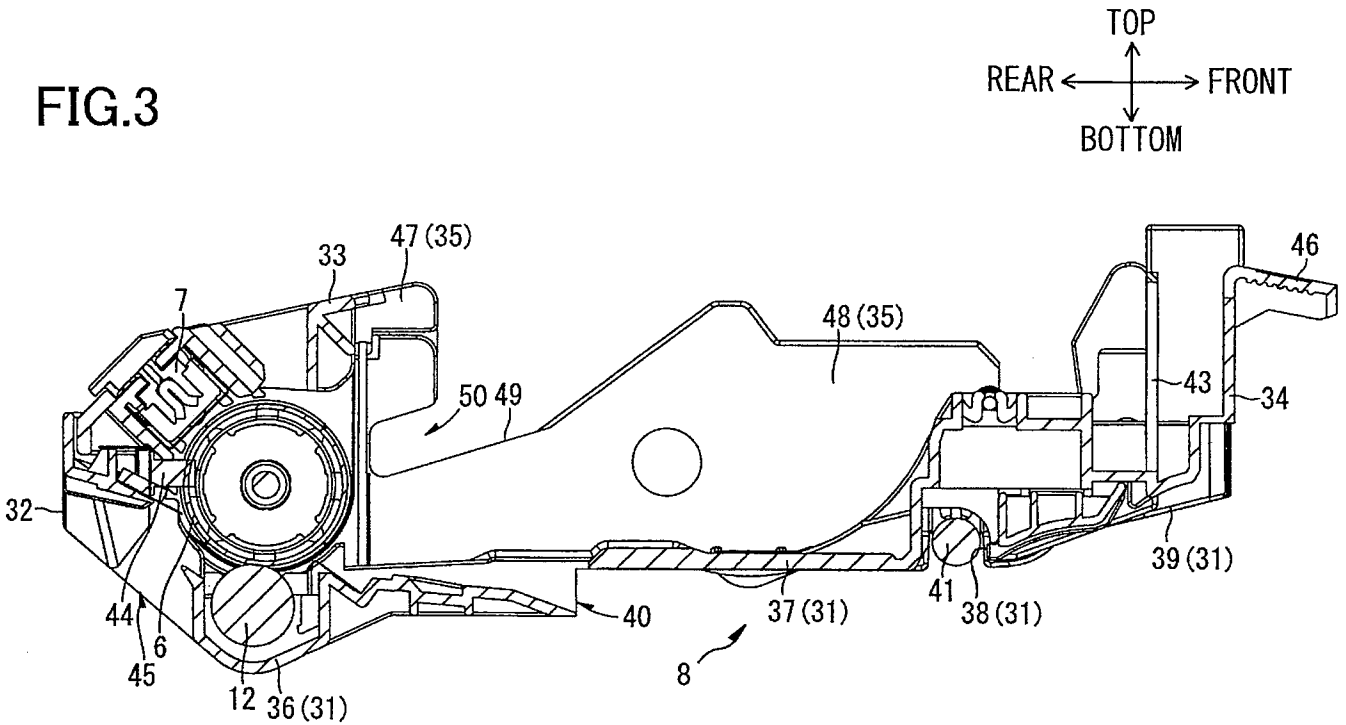
FIG. 3 is a cross-sectional view of a drum cartridge employed in the process cartridge shown in FIG. 2.

As shown in FIG. 3, the drum cartridge 8 is integrally provided with a bottom wall 31, a rear wall 32, a top wall 33, a front wall 34, and right and left side walls 35. The bottom wall 31 is provided with a transfer roller retaining section 36, a developing cartridge mounting section 37, a roller support section 38, and an extending section 39 successively in this order from a rear side of the bottom wall 31 to a front side thereof.

The transfer roller retaining section 36 is generally U-shaped in cross-section, and the U-shape has a top opening. The transfer roller retaining section 36 retains the transfer roller 12 therein. The transfer roller 12 has a rotation shaft, and each end portion of the rotation shaft is rotatably supported to the side wall 35.

The transfer roller retaining section 36 has a front edge from which the developing cartridge mounting section 37 extends frontward. The developing cartridge mounting section 37 is formed in a plate-shape, and formed with an elongated opening 40 extending in a right-to-left direction (hereinafter referred to as "widthwise direction"). The opening 40 is provided at a position in a substantially middle part of the developing cartridge mounting section 37 in the frontward/rearward direction. The opening 40 has a width greater than that of the sheet P (shown in FIG. 1) and is open frontward. The sheet P is conveyed into the drum cartridge 8 through the opening 40, and passes between the photosensitive drum 6 and the transfer roller 12.

The roller support section 38 is generally U-shaped in cross-section, and the U-shape has a bottom opening. The roller support section 38 supports a roller 41. The roller 41 has a rotational shaft, and each end portion of the rotational shaft is rotatably supported to the side wall 35. As shown in FIG. 1, when the process cartridge 3 is assembled to the main casing 2, the roller 41 is in confrontation with a roller 42 provided at the main casing 2. The roller 41 and the roller 42 constitute a registration roller for adjusting a conveying timing of the sheet P.

The roller support section 38 has a front edge from which the extending section 39 extends diagonally above and frontward. The extending section 39 is formed in a generally plate-shape. The extending section 39 is provided with an engaged member 43 upstanding therefrom. The engaged member 43 has a U-shape as viewed from the front side (see FIG. 4), and the U-shape has a bottom opening.

The transfer roller retaining section 36 has a lower portion from which the rear wall 32 extends diagonally above and rearward. The rear wall 32 is bent in its middle section so as to extend upward vertically from the middle section. The rear wall 32 has a front surface provided with a cleaning brush 44. The cleaning brush 44 is employed to remove paper-dust deposited on the photosensitive drum 6. Further, the rear wall 32 is formed with an elongated opening 45 extending in the widthwise direction and disposed below the cleaning brush 44. After the sheet P has passed between the photosensitive drum 6 and the transfer roller 12, the sheet P is conveyed toward the fixing unit 13 (shown in FIG. 1) through the opening 45.

The rear wall 32 has an upper edge from which the top wall 33 extends frontward. The top wall 33 is in confrontation with the transfer roller retaining section 36 in an upper-to-lower direction. The top wall 33 has a rear end portion that is inclined upward toward the front side. Below the rear end portion of the top wall 33, the scorotron charger 7 is disposed.

The extending section 39 has a front edge from which the front wall 34 extends upward. The front wall 34 is formed in a generally plate-shape. The front wall 34 has an upper edge whose middle portion in the widthwise direction is integral with a first handle 46. The first handle 46 is plate-shaped and extends frontward from the upper edge of the front wall 34.

The right and left side walls 35 are formed in substantially the same shape. Each of the side walls 35 is integrally provided with a drum retaining section 47 and a developing cartridge facing section 48. A pair of the drum retaining sections 47 is adapted to close a space defined by the transfer roller retaining section 36, the rear wall 32, and the top wall 33 in the widthwise direction. Each end portion of the photosensitive drum 6 is rotatably supported to the drum retaining section 47.

Each of the developing cartridge facing sections 48 is in confrontation with the developing cartridge 10 when the developing cartridge 10 is mounted on the developing cartridge mounting section 37 of the bottom wall 31.

The drum retaining section 47 has a front edge, and the developing cartridge facing section 48 extends frontward from a lower half portion of the front edge. The developing cartridge facing section 48 has a lower edge that is connected to each widthwise edge of the developing cartridge mounting section 37, the roller support section 38, and the extending section 39. The developing cartridge facing section 48 has a front edge that is connected to a widthwise edge of the front wall 34.

The developing cartridge facing section 48 has an upper edge 49. A rear half portion of the upper edge 49 extends diagonally downward from the front side to the rear side. The upper edge 49 serves as a guide for guiding the developing cartridge 10 when the developing cartridge 10 is detached from or attached to the drum cartridge 8.

The drum retaining section 47 has a front end portion formed with a shaft receiving portion 50. The shaft receiving portion 50 is a substantially rectangular-shaped notch open frontward. The notch is connected to the upper edge portion 49. When the developing cartridge 10 is assembled to the drum cartridge 8, the shaft receiving portion 50 receives a collar member 61 (described later) of the developing cartridge 10.

2-2. Developing Cartridge

Figure 4:
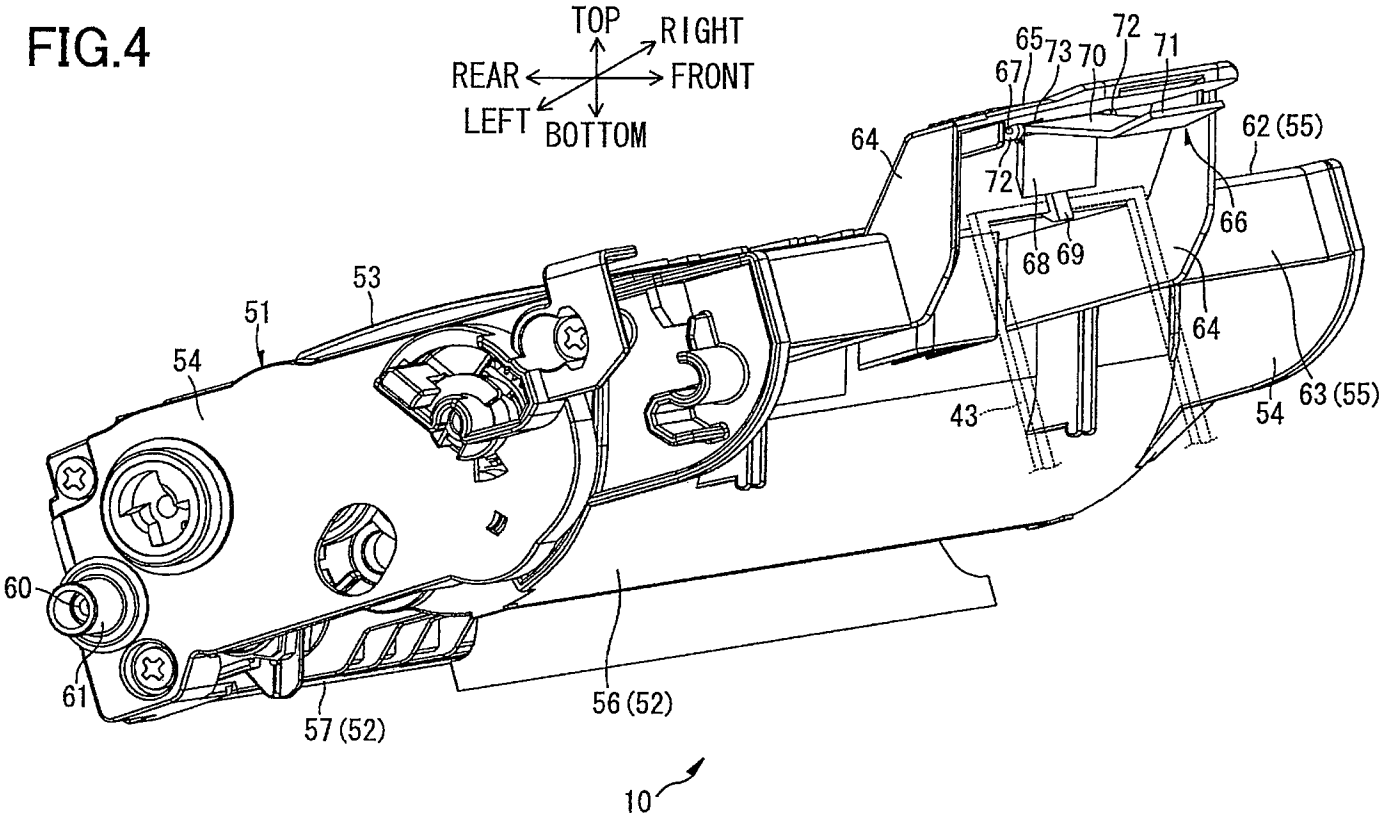
FIG. 4 is a perspective view of a developing cartridge employed in the process cartridge shown in FIG. 2 as viewed from a left front side.
Figure 5:
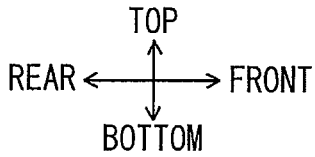
FIG. 5 is a side cross-sectional view of the developing cartridge employed in the process cartridge shown in FIG. 2.
Figure 5:
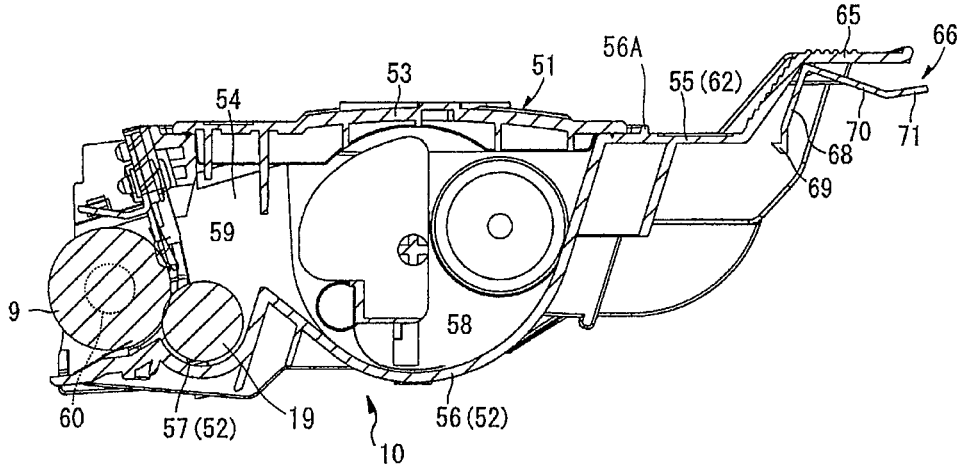

As shown in FIGS. 4 and 5, the developing cartridge 10 includes a box-shaped developing casing 51. The developing casing 51 is integrally provided with a bottom wall 52, a top wall 53, right and left side walls 54, and an extending section 55.

The bottom wall 52 includes a front bottom wall 56 and a rear bottom wall 57. The front bottom wall 56 is formed in an arcuate shape in cross-section. The front bottom wall 56 has a rear edge from which the rear bottom wall 57 extends diagonally downward toward the rear side.

The front bottom wall 56 has an upper edge 56A from which the top wall 53 extends rearward. The top wall 53 is formed in a plate-shape.

The right and left side walls 54 are formed in substantially the same shape. Each of the side walls 54 defines a space in cooperation with the bottom wall 52 and the top wall 53. Accordingly, the developing casing 51 is formed with the space having a rear opening defined by the bottom wall 52, the top wall 53 and the side walls 54.

Further, the space above the front bottom wall 56 is occupied by a toner chamber 58 accommodating toner therein. The space above the rear bottom wall 57 is occupied by a developing chamber 59 in which the developing roller 9 and the toner supply roller 19 are retained. The developing roller 9 has a rotation shaft 60, and each end portion of the rotation shaft 60 rotatably extends through the side wall 54. Each side wall 54 is provided with the collar member 61 having substantially cylindrical shape to cover a portion of the rotation shaft 60, the portion being outwardly protruding from the side wall 54.

The extending section 55 is integrally provided with a horizontal extending section 62 and a vertical extending section 63. The horizontal extending section 62 extends frontward from a front edge of the top wall 53 along an upper edge of the side wall 54. The horizontal extending section 62 has a front edge from which the vertical extending section 63 extends along a front edge of the side wall 54.

Figure 2:
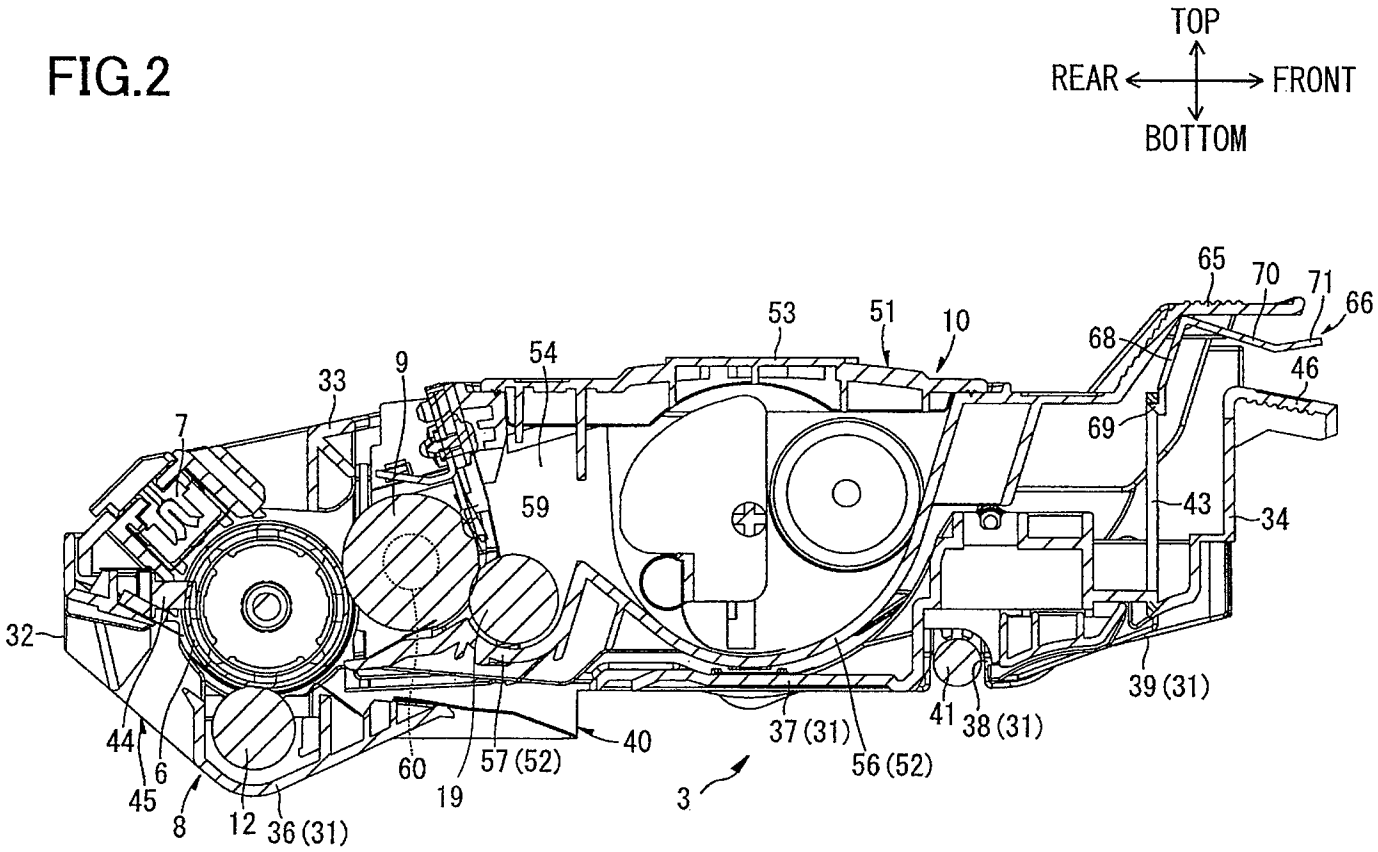
FIG. 2 is a cross-sectional view of a process cartridge employed in the printer shown in FIG. 1.

Further, the extending section 55 is provided with a pair of arms 64 extending diagonally upward and frontward from a front surface of the vertical extending section 63. The pair of the arms 64 is arranged spaced apart from each other in the widthwise direction. Each of the arms 64 has an upper edge, and a plate shaped second handle 65 is bridged between the upper edges of the arms 64. As shown in FIG. 2, when the developing cartridge 10 is mounted on the drum cartridge 8, a front end portion of the second handle 65 is disposed above the first handle 46. The second handle 65 is arranged in confrontation with the first handle 46 and spaced apart from the same.

Figure 6:
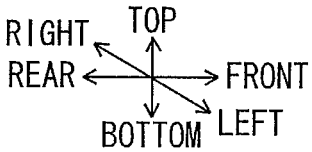
FIG. 6 is a perspective view of a lock member employed in the developing cartridge shown in FIG. 4.
Figure 6:
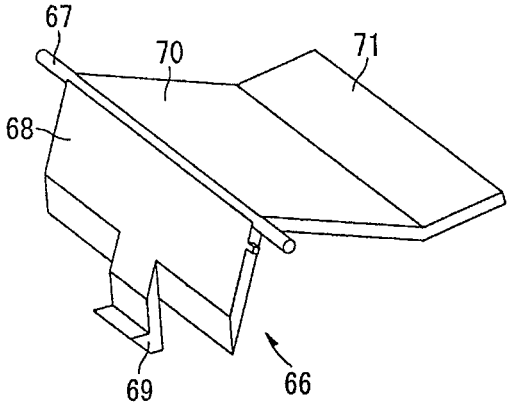

A lock member 66 is disposed below the front end portion of the second handle 65. As shown in FIG. 6, the lock member 66 is integrally provided with a pivot shaft 67, a first planar section 68, a hook 69, a second planar section 70, and an operation section 71.

The pivot shaft 67 extends in the widthwise direction. The first planar section 68 extends downward from the pivot shaft 67. The hook 69 extends downward from a widthwise center portion of a lower end portion of the first planar section 68 and has a free end bent rearward. The second planar section 70 extends frontward from the pivot shaft 67 so as to be perpendicular to the first planar section 68. The second planar section 70 has a front edge from which the operation section 71 extends diagonally upward.

Each end portion of the pivot shaft 67 protrudes from the first planar section 68 and the second planar section 70 in the widthwise direction. As shown in FIG. 4, a lower surface of the second handle 65 is provided with a pair of shaft support portions 72 spaced apart from each other in the widthwise direction. Each of the shaft support portions 72 is formed with a hole allowing each end portion of the pivot shaft 67 to rotatably extend therethrough in the widthwise direction. Since the end portions of the pivot shaft 67 rotatably extend through the holes of the shaft support portions 72, the lock member 66 is pivotally movable about an axis of the pivot shaft 67. The hook 69 is engageable with the engaged member 43 of the drum cartridge 8.

Further, at least one of the end portions of the pivot shaft 67 is provided with a torsion spring 73 at an inner side relative to the shaft support portion 72 in the widthwise direction. The torsion spring 73 has one end fixed to or seated on the second handle 65 and another end fixed to or seated on the first planar section 68. Accordingly, the lock member 66 is constantly biased by the torsion spring 73 in a direction such that the hook 69 is moved rearward (the operation section 71 is moved downward).

2-3. Separation of Developing Cartridge from Drum Cartridge

As shown in FIG. 2, when the developing cartridge 10 is mounted in the drum cartridge 8, the lock member 66 is disposed at a lock position by a biasing force of the coil spring 73. That is, the hook 69 of the lock member 66 is engaged with the engaged member 43 from the front side, so that separation between the drum cartridge 8 and the developing cartridge 10 is prohibited. Further, the operation section 71 of the lock member 66 is disposed above the first handle 46 and below the second handle 65.

Figure 7:
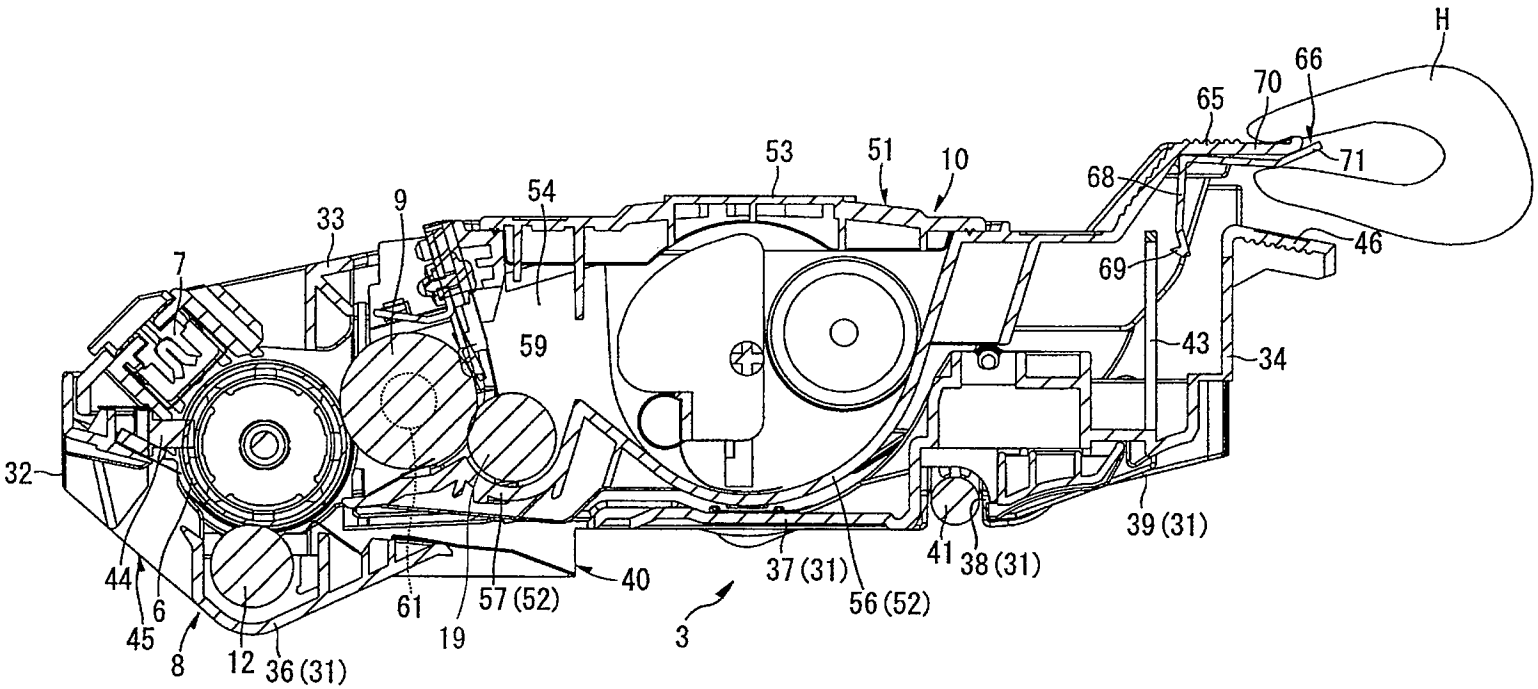
FIG. 7 is a side cross-sectional view of the process cartridge when the developing cartridge is just about to be detached from or attached to the drum cartridge.

When the developing cartridge 10 is separated from the drum cartridge 8, as shown in FIG. 7, the second handle 65 and the operation section 71 of the lock member 66 are collectively held by a single hand H of the user. Then, the operation section 71 is operated so as to be moved closer to the second handle 65. The lock member 66 is thereby moved to an unlock position from the lock position. That is, engagement of the hook 69 relative to the engaged member 43 is released. Thus, separation of the developing cartridge 10 from the drum cartridge 8 is permitted.

Figure 8:
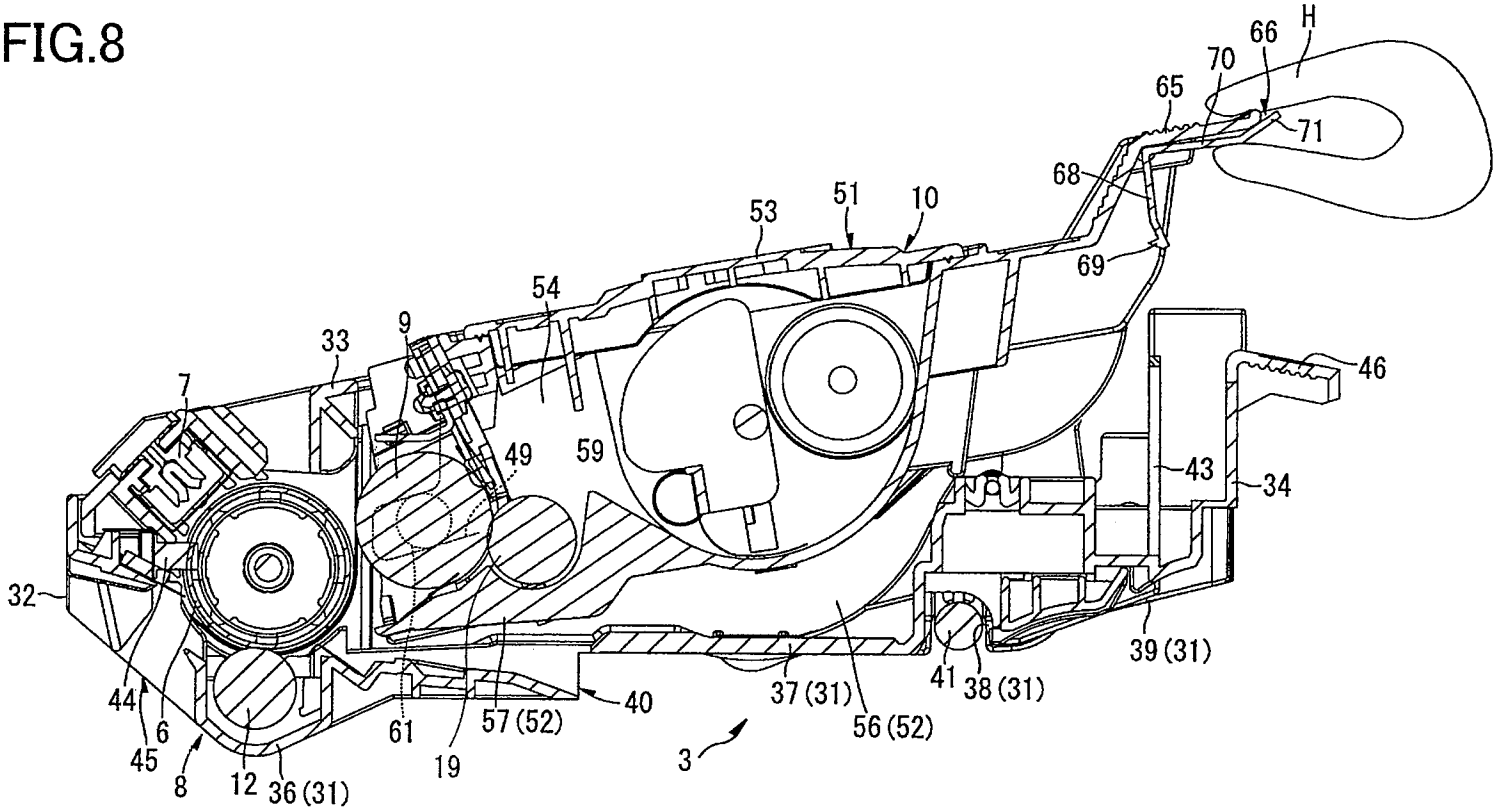
FIG. 8 is a side cross-sectional view of the process cartridge while the developing cartridge is being detached from or attached to the drum cartridge immediately after (for detachment) or before (for attachment) a state shown in FIG. 7.

Next, as shown in FIG. 8, the second handle 65 is lifted upward. The developing cartridge 10 is moved pivotally about an axis of the collar member 61 and diagonally above. Hence, a front end portion of the developing cartridge 10 is lifted upward.

Figure 9:
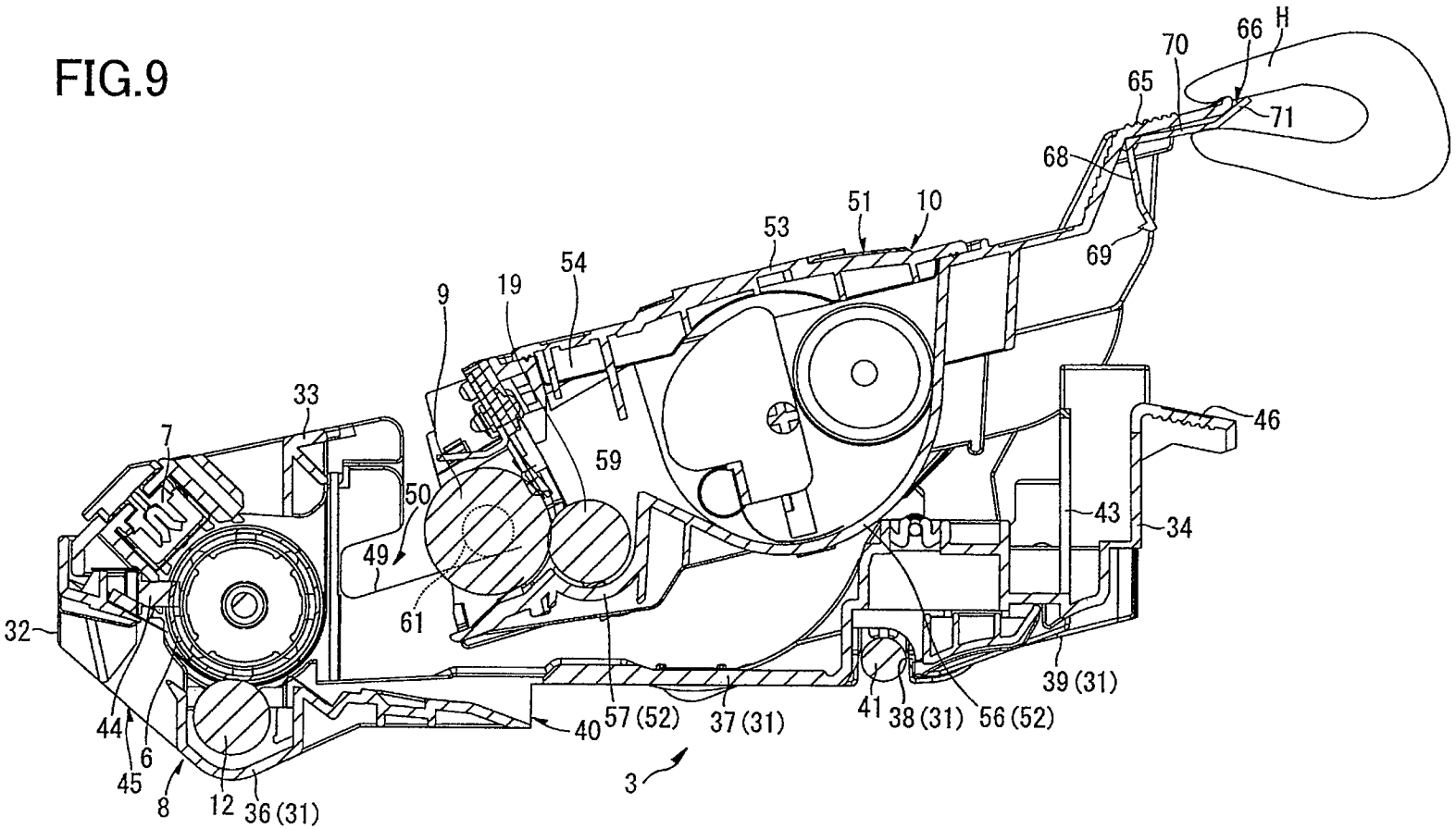
FIG. 9 is a side cross-sectional view of the process cartridge while the developing cartridge is being detached from or attached to the drum cartridge immediately after or before a state shown in FIG. 8.

Subsequently, as shown in FIG. 9, the second handle 65 is pulled frontward. Therefore, the collar member 61 is slidingly moved frontward along the upper edge 49 of the side walls 35 of the drum cartridge 8. Accordingly, the developing cartridge 10 is entirely moved away from the drum cartridge 8.

Figure 10:
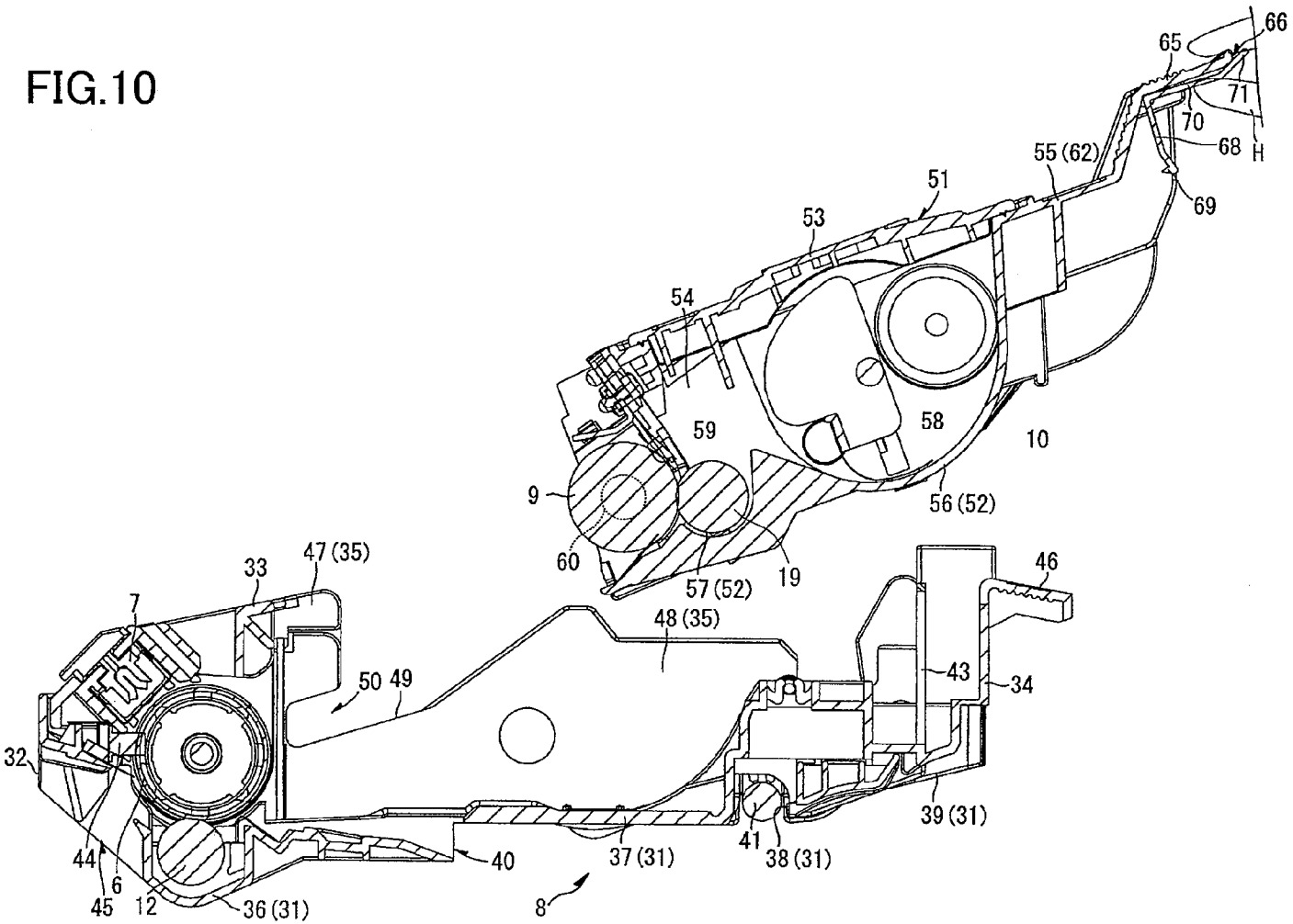
FIG. 10 is a side cross-sectional view of the process cartridge when the developing cartridge has been detached from the drum cartridge immediately after or before a state shown in FIG. 9.

Then, as shown in FIG. 10, when the collar member 61 is removed from the upper edge 49, the developing cartridge 10 is completely separated from the drum cartridge 8.

2-4. Assembly of Developing Cartridge to Drum Cartridge

When the developing cartridge 10 is assembled to the drum cartridge 8, the second handle 65 is held by the single hand H of the user. Here, as shown in FIG. 10, the operation section 71 of the lock member 66 may also be held together with the second handle 65. Then, the developing roller 9 is positioned above the drum cartridge 8 so as to be directed toward the photosensitive drum 6.

Next, the developing cartridge 10 is moved closer to the drum cartridge 8. As shown in FIG. 9, the collar member 61 is disposed on the upper edge 49 of the side walls 35 of the drum cartridge 8. Subsequently, the developing cartridge 10 is moved rearward. Accordingly, the collar member 61 is slidingly moved on the upper edge 49. Then, as shown in FIG. 8, the collar member 61 is received by the shaft receiving portion 50 (FIG. 9). When the collar member 61 is received by the shaft receiving portion 50, a position of the rear end portion of the developing cartridge 10 in the upper-to-lower direction is fixed.

Then, when the second handle 65 is pressed downward, the developing cartridge 10 is pivotally moved about the axis of the collar member 61 downward. The developing cartridge 10 is then placed on the developing cartridge mounting section 37 of the drum cartridge 8, so that assembly of the developing cartridge 10 to the drum cartridge 8 is completed. In a case where the operation section 71 is held by the hand H together with the second handle 65, when the hand H is released from the second handle 65 and the operation section 71 after assembly of the developing cartridge 10 to the drum cartridge 8, the lock member 66 is moved from the unlock position to the lock position by the biasing force of the torsion spring 73. The hook 69 of the lock member 66 is brought into engagement with the engaged member 43 from the front side.

As described above, according to the above-described embodiment, when the developing cartridge 10 is mounted in the drum cartridge 8, the first handle 46 and the second handle 65 are arranged in confrontation with and spaced apart from each other. Accordingly, when the developing cartridge 10 is mounted in the drum cartridge 8, the first handle 46 and the second handle 65 can be collectively held by the single hand H.

Further, when the developing cartridge 10 is mounted in the drum cartridge 8, the lock member 66 is normally at the lock position. Accordingly, by holding both of the first handle 46 and the second handle 65 collectively, both of the drum cartridge 8 and the developing cartridge 10 can be integrally detached from and attached to the main casing 2.

By holding the second handle 65 and the operation section 71 of the lock member 66, the lock member 66 is moved to the unlock position from the lock position. Hence, separation of the developing cartridge 10 from the drum cartridge 8 is permitted. Accordingly, when the drum cartridge 8 and the developing cartridge 10 are mounted in the main casing 2, only the developing cartridge 10 can be removed from the main casing 2 while the drum cartridge 8 remains in the main casing 2 by operating the second handle 65 and the operation section 71 of the lock member 66. Further, after the drum cartridge 8 and the developing cartridge 10 have been integrally removed from the main casing 2, the developing cartridge 10 can be separated from the drum cartridge 8 by operating the second handle 65 and the operation section 71 of the lock member 66.

Accordingly, while the process cartridge 3 can prevent the developing cartridge 10 from undesired separation from the drum cartridge 8, operability of the second handle 65 and the operation section 71 can also be enhanced when the developing cartridge 10 is separated from the drum cartridge 8.

Further, the operation section 71 of the lock member 66 is disposed above the first handle 46 and below the second handle 65. Therefore, when the first handle 46 and the second handle 65 are collectively held, the operation section 71 is incapable of being operated. Consequently, when the drum cartridge 8 and the developing cartridge 10 are integrally removed from the main casing 2, occurrence of undesired separation of the developing cartridge 10 from the drum cartridge 8 can be reliably prevented.

Further, the lock member 66 is supported to the developing cartridge 10. Therefore, the operation section 71 of the lock member 66 and the second handle 65 provided at the developing cartridge 10 are collectively held without difficulty.

Further, when the developing cartridge 10 is mounted in the drum cartridge 8, a downstream side of the developing cartridge 10 in a direction such that the developing cartridge 10 is moved to be mounted in the drum cartridge 8, that is, the rear side of the developing cartridge 10, is initially subjected to positioning in the upper-to-lower direction. Subsequently, an upstream side of the developing cartridge 10 in the direction, that is, the front side of the developing cartridge 10, is subjected to positioning in the upper-to-lower direction. Therefore, vertical positioning of the developing cartridge 10 at its downstream side relative to the drum cartridge 8 can be accurately made.

Figure 11:
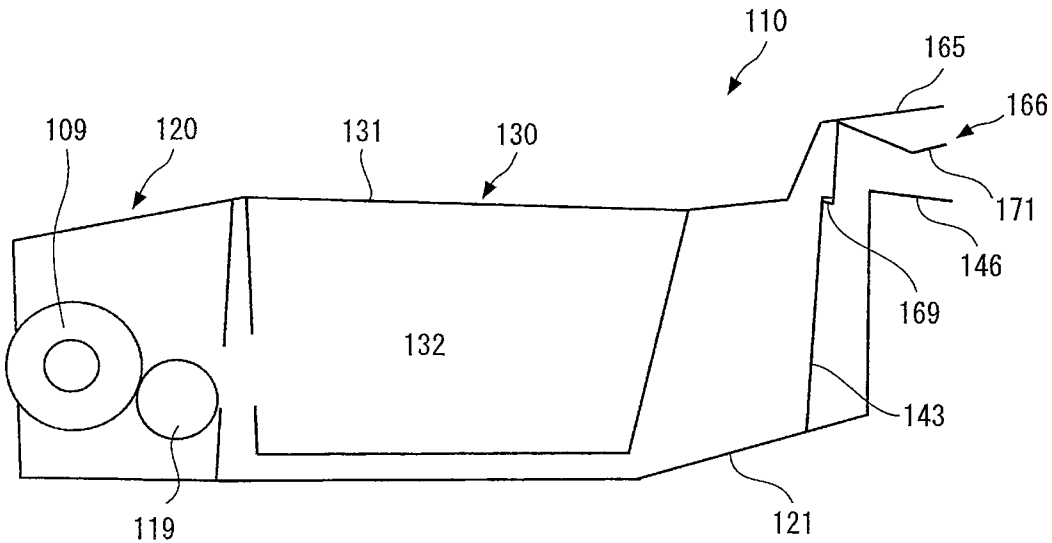
FIG. 11 is a schematic view of a roller cartridge and a toner cartridge assembled to a developing unit.

In the above embodiment, the process cartridge 3 includes the drum cartridge 8 and the developing cartridge 10. However, the present invention is also available to a developing unit 110 (cartridge assembly) having a roller cartridge 120 (first cartridge) and a toner cartridge 130 (second cartridge) detachably mounted to the roller cartridge 120, as schematically shown in FIG. 11.

The developing unit 110 is detachably mounted relative to a main casing (not shown) of an image forming device (not shown).

The roller cartridge 120 accommodates therein a developing roller 109 and a toner supply roller 119. The roller cartridge 120 has a casing 121. The casing 121 is provided with a first handle 146 and an engaged member 143. The first handle 146 corresponds to the first handle 46 in the above-described embodiment. The engaged member 143 corresponds to the engaged member 43 in the above-described embodiment.

The toner cartridge 130 has a casing 131 defining therein a toner chamber 132 in which toner is accommodated. The casing 131 is provided with a second handle 165 that corresponds to the second handle 65 in the above-described embodiment. The casing 131 is provided with a lock member 166, and the lock member 166 includes a hook 169 and an operation section 171. The lock member 166, the hook 169, and the operation section 171 correspond to the lock member 66, the hook 69, and the operation section 71 in the above-described embodiment, respectively. The hook 169 is engageable with the engaged member 143 of the roller cartridge 120. The operation section 171 is disposed below the second handle 165. When the toner cartridge 130 is mounted in the roller cartridge 120, the hook 169 of the lock member 166 is engaged with the engaged member 143. When the toner cartridge 130 is detached from the roller cartridge 120, the hook 169 is disengaged from the engaged member 143 by operating the operating section 171.

While the invention has been described in detail with reference to the embodiment thereof, it would be apparent to those skilled in the art that various changes and modifications may be made therein without departing from the spirit of the invention.

What is claimed is:

1. A cartridge assembly detachably mountable on a main casing of an image forming device, the cartridge assembly comprising:

a first cartridge including a photosensitive drum on which a latent image is to be formed, a first handle, and an engaged portion; and an elongated second cartridge detachably mountable on the first cartridge and including a developing casing, wherein the developing casing includes a developing roller for forming an image on the photosensitive drum, a second handle, and a lock member, the first handle and the second handle being configured in a relative position capable of single-handed simultaneous access to the first and second handles when the first and second cartridges are in an assembled state, wherein the developing casing of the second cartridge continues to support the developing roller and the lock member when the second cartridge has been separated from the first cartridge, wherein the lock member of the second cartridge includes a lock section configured to be engageable with the engaged portion, and an operation section, the lock section being movable between a lock position to prohibit separation of the second cartridge from the first cartridge and an unlock position to permit separation of the second cartridge from the first cartridge, the operation section being configured to move the lock section between the lock position and the unlock position, and the second handle and the operation section being configured in a relative position, capable of single-handed simultaneous access to the second handle and the operation section, wherein the lock member of the second cartridge further includes an opposing section, the opposing section configured to move between the lock position and the unlock position, the second handle of the second cartridge being oriented substantially parallel to the opposing section when the lock member is in the unlock position, and wherein the second cartridge including the developing roller is configured to be pivotable, relative to the first cartridge, about a point arranged on a developing roller side of the second cartridge, and the operation section of the lock member is disposed on a handle side opposite to and distanced from, in an elongated direction of the second cartridge, the developing roller side and disposed below the second handle of the second cartridge such that, when the second cartridge is mounted on the first cartridge, the operation section of the lock member is disposed between the first and second handles, and such that, when the second handle and the operation section are simultaneously operated to be moved upward, the second cartridge pivots, relative to the first cartridge, about the point arranged on the developing roller side.

2. The cartridge assembly as claimed in claim 1, wherein the first handle and the second handle are arranged in confrontation with each other and spaced apart from each other in the assembled state of the second cartridge to the first cartridge.

3. The cartridge assembly as claimed in claim 2, wherein the operation section is positioned between the first handle and the second handle in the assembled state of the second cartridge to the first cartridge.

4. The cartridge assembly as claimed in claim 1, further comprising a biasing member that biases the lock member toward the lock position.

5. The cartridge assembly as claimed in claim 1, wherein the second cartridge has a leading end portion and a trailing end portion in a mounting direction of the second cartridge onto the first cartridge, and wherein the second cartridge further comprises a positioning portion at the leading end portion, and the first cartridge defines a receiving portion engageable with the positioning potion to define a vertical position of the leading end portion relative to the first cartridge, the trailing end portion being mounted on the first cartridge subsequent to the positioning of the leading end portion.

6. The cartridge assembly as claimed in claim 5, wherein the point about which the second cartridge is configured to be pivotally movable, relative to the first cartridge, corresponds to the positioning portion, and wherein the second cartridge is configured to be pivotally movable in a direction of initial separation of the second cartridge from the first cartridge for detachment of the second cartridge from the first cartridge.

7. The cartridge assembly as claimed in claim 1, wherein the first cartridge is a drum cartridge accommodating therein the photosensitive drum, and the second cartridge is a developing cartridge accommodating therein the developing roller and a developing agent, whereby the cartridge assembly functions as a process cartridge.

8. The cartridge assembly as claimed in claim 1, wherein the engaged portion is formed in an inverted U-shape upstanding from a bottom wall of the first cartridge.

* * * * *